US009795972B2

(12) United States Patent
Sams et al.

(10) Patent No.: US 9,795,972 B2
(45) Date of Patent: Oct. 24, 2017

(54) HIGH TEMPERATURE HIGH PRESSURE ELECTROSTATIC TREATER

(75) Inventors: Gary W. Sams, Spring, TX (US); Everett Kamandala Minga, Salt Lake City, UT (US)

(73) Assignee: Cameron International Corporation, Houston, TX (US)

( * ) Notice: Subject to any disclaimer, the term of this patent is extended or adjusted under 35 U.S.C. 154(b) by 665 days.

(21) Appl. No.: 13/568,886

(22) Filed: Aug. 7, 2012

(65) Prior Publication Data

US 2014/0042028 A1 Feb. 13, 2014

(51) Int. Cl.

| | |
|---|---|
| ***C10G 33/02*** | (2006.01) |
| ***B03C 11/00*** | (2006.01) |
| ***C10G 1/00*** | (2006.01) |
| ***C10G 1/04*** | (2006.01) |

(52) U.S. Cl.

CPC ..... *B03C 11/00* (2013.01); *C10G 1/002* (2013.01); *C10G 1/047* (2013.01); *C10G 33/02* (2013.01); *B03C 2201/02* (2013.01); *B03C 2201/24* (2013.01)

(58) Field of Classification Search

CPC ..... C10G 33/02–33/04; B03C 11/00

See application file for complete search history.

(56) References Cited

U.S. PATENT DOCUMENTS

| | | | | |
|---|---|---|---|---|
| 3,130,142 | A | | 4/1964 | Nathan et al. |
| 3,574,087 | A | | 4/1971 | Bergen |
| 3,661,746 | A | * | 5/1972 | Lucas ..... 204/563 |
| 3,887,453 | A | | 6/1975 | Ueta et al. |
| 4,042,485 | A | | 8/1977 | Jones, Jr. et al. |
| 4,116,810 | A | | 9/1978 | Jones, Jr. et al. |
| 4,160,720 | A | | 7/1979 | Seader et al. |
| 4,181,596 | A | | 1/1980 | Jensen |
| 4,193,862 | A | | 3/1980 | Ban et al. |
| 4,226,689 | A | * | 10/1980 | Mayse et al. ..... 204/563 |
| 4,388,173 | A | | 6/1983 | Escher et al. |

(Continued)

FOREIGN PATENT DOCUMENTS

| | | |
|---|---|---|
| EP | 0648522 | 4/1995 |
| GB | 2084179 | 4/1982 |
| WO | 2010/134821 | 11/2010 |

OTHER PUBLICATIONS

Thomason et al., Advanced Electrostatic Technologies for Dehydration of Heavy Oils, 2005 SPE International Thermal Operations and Heavy Oil Symposium (2005).*

*Primary Examiner* — Bryan D. Ripa
*Assistant Examiner* — Ho-Sung Chung
(74) *Attorney, Agent, or Firm* — Gable Gotwals

(57) ABSTRACT

A high temperature high pressure electrostatic treater and method of use are described for removing water from heavy crude oil. The electrostatic treater is comprised of a vessel with a wet bitumen inlet and water outlet in the upper portion of the vessel, a dry bitumen outlet in the lower portion of the vessel, a plurality of electrodes on an electrically isolating support inside the vessel, an entrance bushing, and an interface control to regulate the flow of water through the water outlet. The water outlet is located above the dry bitumen outlet. The electrostatic treater and method reduce the amount of diluent needed to process the heavy crude when compared to the prior art.

3 Claims, 5 Drawing Sheets

(56) References Cited

U.S. PATENT DOCUMENTS

| | | | | | |
|---|---|---|---|---|---|
| 4,702,815 | A | * | 10/1987 | Prestridge | B01D 17/06 204/673 |
| 4,944,867 | A | | 7/1990 | Mundstock et al. | |
| 5,041,210 | A | | 8/1991 | Merrill, Jr. et al. | |
| 5,068,010 | A | | 11/1991 | Mundstock et al. | |
| 5,236,577 | A | * | 8/1993 | Tipman et al. | 208/390 |
| 6,113,765 | A | * | 9/2000 | Wagner | B01D 17/042 204/556 |
| 6,139,722 | A | | 10/2000 | Kirkbride et al. | |
| 6,319,395 | B1 | | 11/2001 | Kirkbride et al. | |
| 2009/0321323 | A1 | * | 12/2009 | Sharma | C10G 1/002 208/390 |

* cited by examiner

HIGH TEMPERATURE HIGH PRESSURE ELECTROSTATIC TREATER

FIELD OF THE INVENTION

The present invention relates generally to pretreatment of heavy crude oil. More particularly, the present invention relates to a high pressure and high temperature electrostatic treater apparatus and method for removing water from heavy crude oil.

BACKGROUND OF THE INVENTION

Light crude oils have long been favored by refiners due to their ease of refining and lack of needed additional treatment. However, as demand for crude oil increases and the availability of light crude declines, refiners have turned to heavier crude oils for refining. This requires development of methods and equipment for producing, handling, transporting, and refining medium, heavy, and extra heavy crude oil.

Venezuela and Canada produce much of the heavy crude or bitumen, which has a gravity of 6 to 9 API. Diluents are typically used in the production of this heavy crude to raise the gravity to 16 to 18 API. One of these production methods is known as Steam-Assisted Gravity Drain (SAGD). The SAGD process operates by injecting steam into the formation at temperatures of up to 600° F. and pressures up to 1200 PSI.

As the bitumen is brought to the surface, the temperature drops to 400-440° F. The bitumen contains 70% water, but even at 440° F. it remains heavier than water and therefore sinks. In order to use traditional oil production equipment, the API of the bitumen is raised to about 16 API by the addition of diluents equivalent to 15-35% by weight. This results in a temperature drop of the emulsion to about 300° F. with about 50-55% water cut. The resulting diluent emulsion (commonly referred to as dilbit) is fed to a free water knockout tank (FWKO) where most of the water is removed by gravity. From the FWKO the emulsion containing 10-25% water is fed into an electrostatic treater where it is electrostatically dehydrated.

Another production method for extra heavy oil is surface mining operations. Tar sands dug from the earth are transported by conveyor belt to a ball crusher for size reduction. The crushed ore is fed to a steam stripper at 185° F. and slurried with hot water and caustic soda. The froth is then pumped to a Primary Separation Vessel (PSV) where the froth rises to the surface of the vessel and a diluent is then added. The emulsion is then fed into a centrifuge for separation of water and other solid particles.

In certain applications flash treaters are used to remove water from the dilbit. The 300° F. bitumen is depressurized into a vessel which permits the water to be removed as vapor. However, flash dehydration leaves crystalline salt in the crude which causes severe desalting problems at the refinery.

The problem with the prior art method of processing heavy crude is the sheer volume of diluent needed. For example, the volume of bitumen reserves in Canada is estimated to be 1.7 trillion barrels. It is estimated that only 10% of this bitumen is recoverable using currently known technology. Whether the bitumen is produced by mining or SAGD it must be diluted for transport and processing. Assuming a modest diluent usage of only 15%, the industry will need 25 billion barrels of diluent to sustain bitumen production. Assuming this production lasts for 15 years, the diluent demand would be nearly 1.7 billion barrels per year. This is well beyond any rational expectation.

BRIEF SUMMARY OF THE INVENTION

The present invention is a high temperature high pressure electrostatic treater and process for handling heavy crude. The treater has a vessel defining an interior volume. A wet bitumen inlet, a dry bitumen outlet, a water outlet, and an entrance bushing all pass through the vessel and into the interior volume. The water outlet is located at a level which is higher than the level of the dry bitumen outlet. The voltage from a high voltage transformer is fed via an electrical conductor through the entrance bushing to a plurality of electrodes located in the interior volume. A flow control (not shown) regulates the flow rate of wet bitumen entering the vessel. An interface control regulates the rate of water exiting the vessel through the water outlet.

When using the present invention, produced heavy crude or bitumen with a gravity of 8 API and 60% to 70% water at approximately 440° F. is fed into a free water knockout tank to remove excess water. Coming out of the free water knockout tank the gravity and temperature of the bitumen remain basically unchanged; however, the water content is reduced to 10% to 25%. Diluent may be added to the bitumen before it enters the high temperature high pressure electrostatic treater. Once inside the treater, the wet bitumen is subjected to electrostatic charges from the electrodes, which separates the water from the bitumen. The water is removed from the vessel through the water outlet while the dry bitumen is removed through the dry bitumen outlet.

The present invention can also be used to treat oil sands ore and other ore containing bitumen. The ore is crushed to a suitable size in a ball crusher. The bitumen is separated using a steam stripper into a froth containing solids having a gravity of approximately 8 API. Excess water is removed from the froth using a separation vessel. The froth is then introduced into the high temperature high pressure electrostatic treater which further separates the water from the bitumen as explained above.

The present invention achieves its objections by providing a high temperature high pressure electrostatic treater and method of use by pulling the separated water from a level above the level where the dry bitumen is removed. The process reduces the amount of diluent needed to process the heavy crude.

BRIEF DESCRIPTION OF THE DRAWINGS

Preferred embodiments of the invention will now be described in further detail. Other features, aspects, and advantages of the present invention will become better understood with regard to the following detailed description, appended claims, and accompanying drawings (which are not to scale) where:

DETAILED DESCRIPTION OF THE PREFERRED EMBODIMENT(S)

Figure 1:
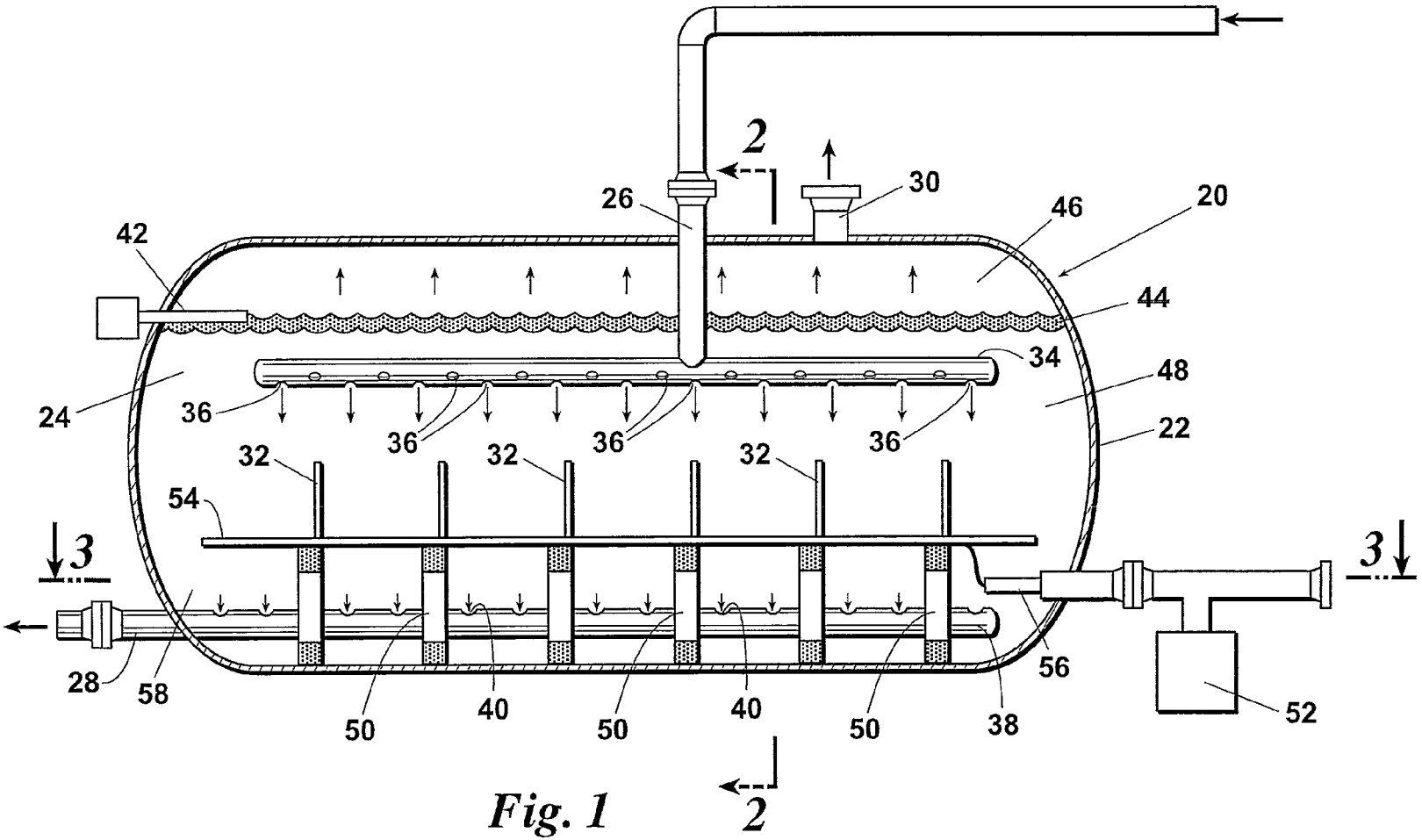
FIG. 1 is a sectional side view showing one embodiment of the electrostatic treater of the present invention.
Figure 2:
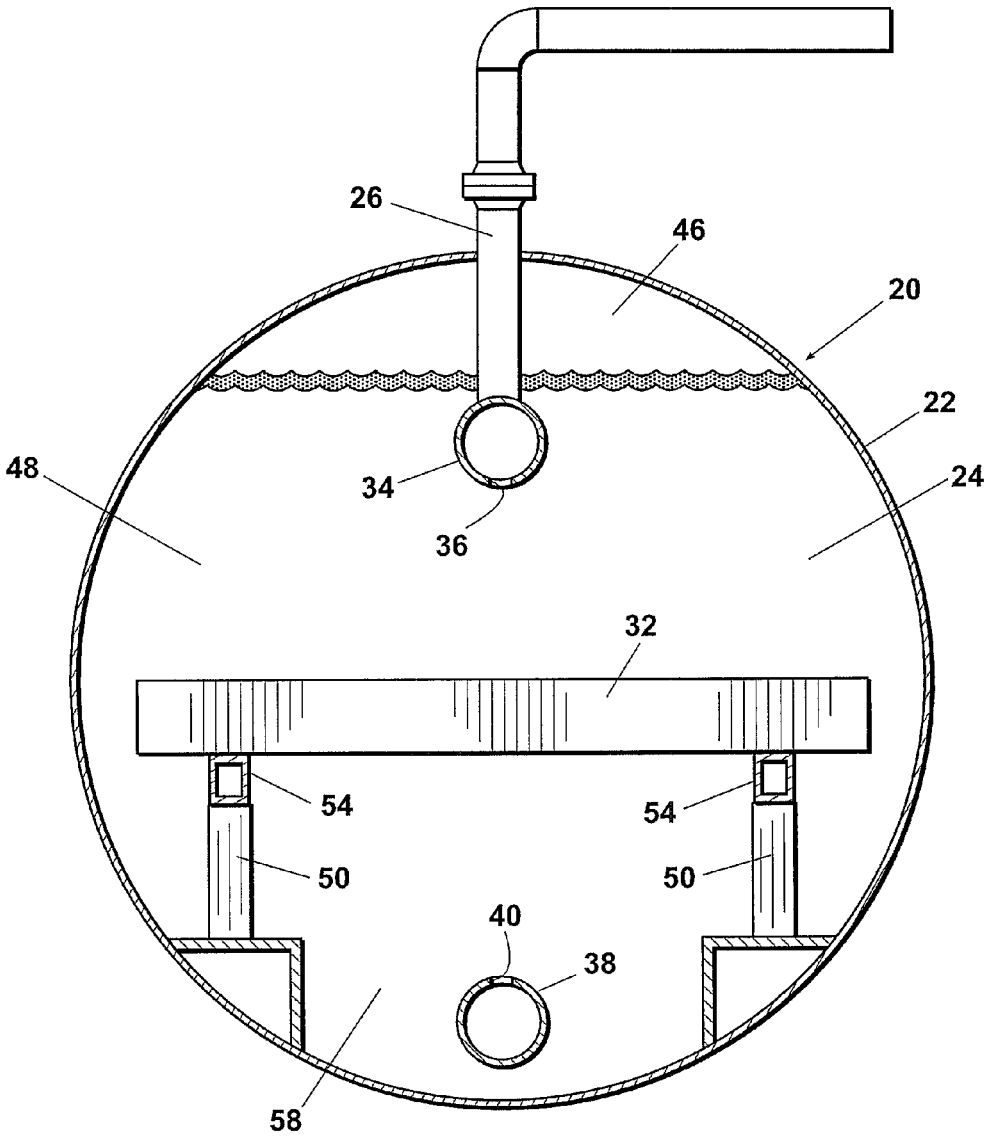
FIG. 2 is a cross-sectional end view of one embodiment of the electrostatic treater of the present invention.
Figure 3:
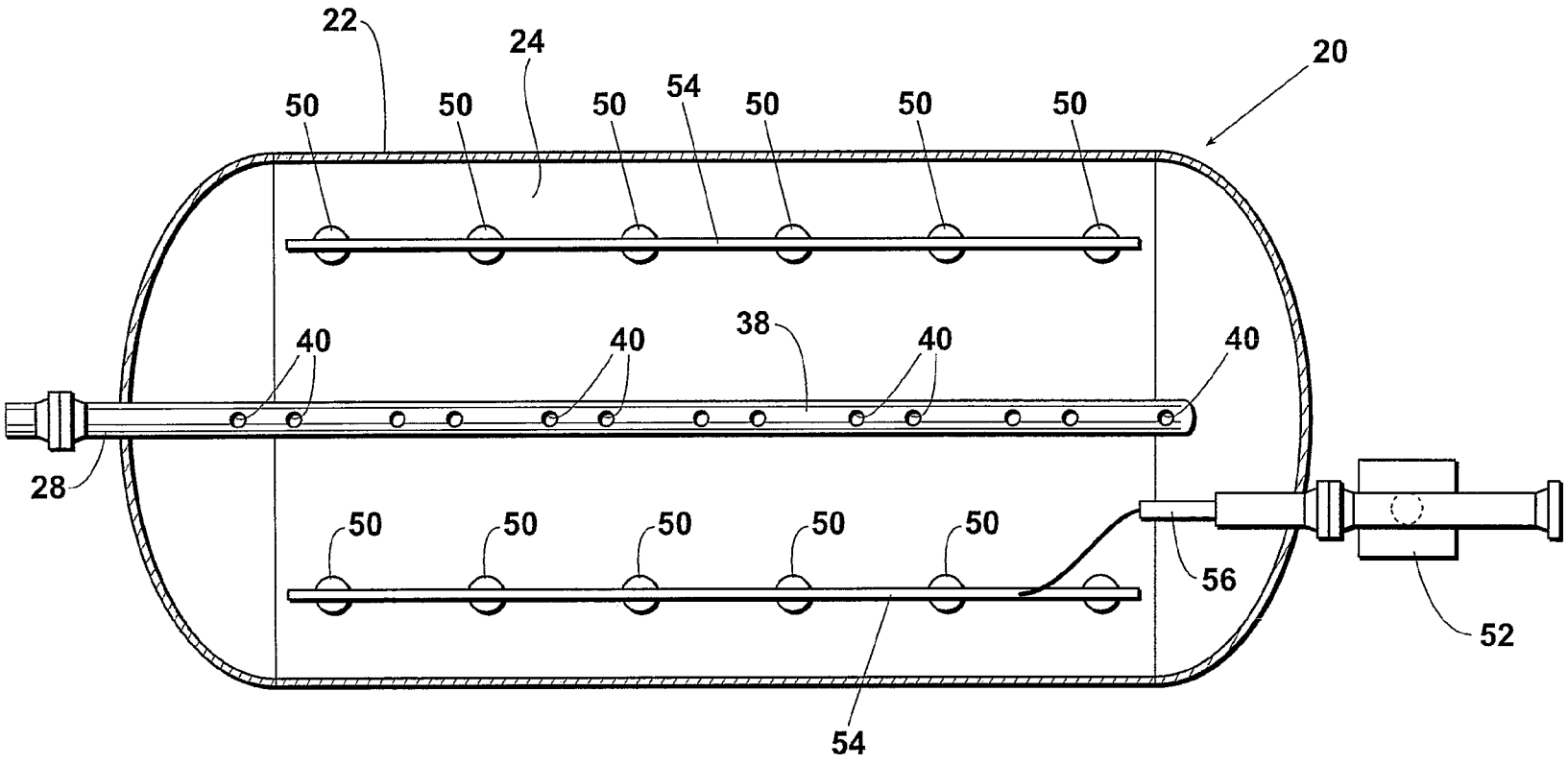
FIG. 3 is a section top view of one embodiment of the electrostatic treater of the present invention.

Turning now to FIG. 1, it can be seen that one embodiment of the high temperature high pressure electrostatic treater 20 has a vessel 22 which defines an interior volume 24. The high temperature high pressure electrostatic treater 20 also has a wet bitumen inlet 26, a dry bitumen outlet 28, and a water outlet 30, all of which are in fluid communication with the interior volume 24 of the vessel 22. One or more electrodes 32 are located in the interior volume 24. The wet bitumen inlet 26 is in fluid communication with a header 34 and nozzles 36 which are used to inject wet bitumen into the interior volume 24 of the vessel 22.

The dry bitumen outlet 28 is in fluid communication with a header 38 with a plurality of collection ports 40. Dry bitumen 28 is removed from the interior volume 24 through the header 38, collection ports 40, and dry bitumen outlet 28. Similarly, the water outlet 30 is used to extract water from the interior volume 24 of the vessel 22.

In the preferred embodiment of the present invention as shown in FIG. 1, the water outlet 30 is located at a level above the level of the dry bitumen outlet 28 and its header 38 and collection ports 40. Thus the water is removed from the interior volume 24 of the vessel 22 in an upper region of the vessel 22.

An interface control 42 locates the boundary layer 44 between the water zone 46 and the wet bitumen zone 48. This information is used to control the outflow of water. The wet bitumen flow into the vessel 22 is controlled such that the treater 20 is able to continuously process or separate the bitumen and water. Excessive flow results in wet bitumen being pumped into the bitumen outlet 28.

The present invention contemplates using one or more electrodes 32 supported in the wet bitumen zone 48 on insulating supports 50 which electrically isolate the electrodes 32 from the vessel 22. In the preferred embodiment the electrodes are made of steel; however, other materials may be used and still be within the scope of this invention. Likewise the supports 50 of the preferred embodiment are constructed from Teflon®; however, other materials could be substituted and still fall within the present invention. These supports 50 support the electrodes 32 while in compression; however, other embodiments of the present invention may include supporting the electrodes 32 with the support 50 in tension or otherwise suspending the electrodes 32.

Power from a high voltage transformer 52 is supplied to the electrodes 32 via one or more high voltage rails 54. An entrance bushing 56 passes through the vessel 22 and provides an insulated passageway for an electrical conductor to run from the high voltage transformer 52 to the high voltage rails 54. This prevents the vessel 22 from being electrically charged.

Figure 4:
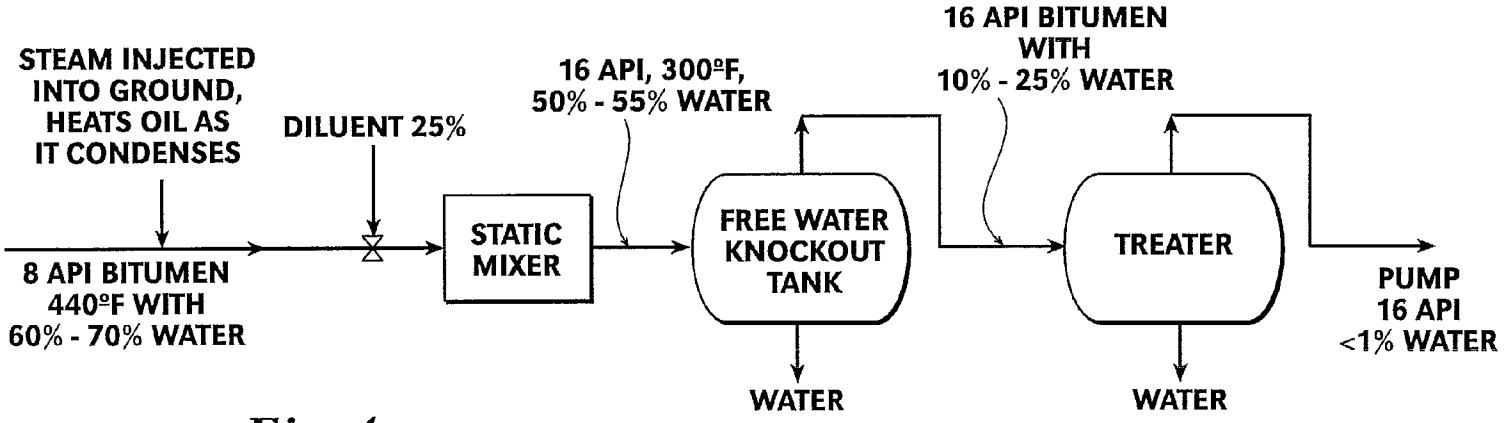
Fig. 4 ( PRIOR ART )
FIG. 4 is a flow diagram showing the prior art water separation process.

As shown in FIG. 4, the prior art process of separating water from the wet bitumen involves produced bitumen typically having approximately a gravity of 8 API at 440° F. with 60-70% water. This wet bitumen is mixed with approximately 25% by weight of diluent. The wet bitumen and diluent mix (or dilbit) is mixed to a homogenous consistency in a static mixer. Coming out of the static mixer the dilbit has a gravity of approximately 16 API at 300° F. with 50-55% water. The free water is removed in a free water knockout tank. The remaining dilbit with a gravity of approximately 16 API and 10-25% water is then run through an electrostatic treater where the remaining water is removed from the bottom of the treatment vessel. The dry bitumen, which has a gravity of approximately 16 API and less than 1% water, floats on top of the water and is removed from the top of the treater.

Figure 5:
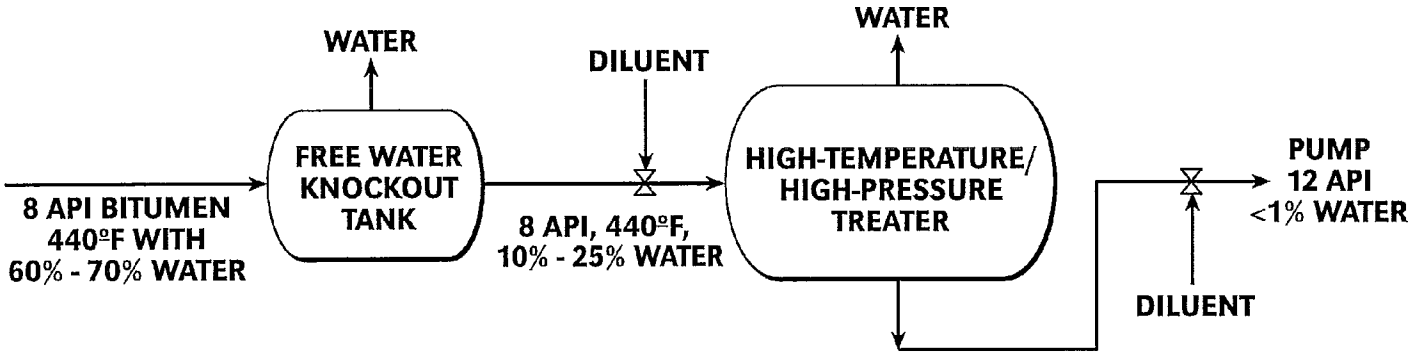
FIG. 5 is a flow diagram showing one embodiment of the process of the present invention.

FIG. 5 shows one embodiment of the present invention process of removing water from bitumen. The bitumen is produced and initially has a gravity of approximately 8 API at a temperature of 440° F. with 60-70% water. The free water is removed from the wet bitumen in a free water knockout tank. Coming out of the free water knockout tank, the wet bitumen has a gravity of 8 API with a temperature of 440° F. and 10-25% by weight in water. A small volume of diluent may be added to create a dilbit, which is then introduced into the high temperature high pressure electrostatic treater. The amount of diluent added is preferably less than 10% by weight of the dilbit. Alternatively, the wet bitumen may be sent directly to the electrostatic treater without the addition of diluent.

The dilbit or wet bitumen enters the interior volume 24 of the vessel 22 through the wet bitumen inlet 26, header 34, and nozzles 36 and flows into the wet bitumen zone 48. Electrical charges from one or more electrodes 32 are used to separate the water from the bitumen. Once separated, the water has a lower density than the dry bitumen and wet bitumen and therefore the water migrates to the top of the interior volume 24 into the water zone 46. The dry bitumen has a heavier density than the water and the wet bitumen and therefore the dry bitumen migrates to the bottom of the interior volume 24 of the vessel 22 into the dry bitumen zone 58.

The water in the water zone 46 is removed through the water outlet 30. Similarly, the dry bitumen is removed from the dry bitumen zone 58 through one or more of the collection ports 40 where it is then moved through the header 38 and out through the dry bitumen outlet 28. The interface control 42 controls the outflow rate of the water and helps maintain the boundary layer 44 at the proper level to avoid forcing untreated wet bitumen out the water outlet 30.

During treatment the temperature in the interior volume 24 of the vessel 22 is maintained within the range of about 380° F. to about 460° F. In the preferred embodiment, the ideal temperature is approximately 420° F. The pressure in the interior 24 of the vessel 22 during treatment is maintained within the range of about 195 PSIA to about 467 PSIA. In the preferred embodiment, the ideal pressure is approximately 310 PSIA.

Once removed from the vessel 22 additional diluents may be added so the dry bitumen has a gravity of approximately 12 API with less than 1% water.

Figure 6:
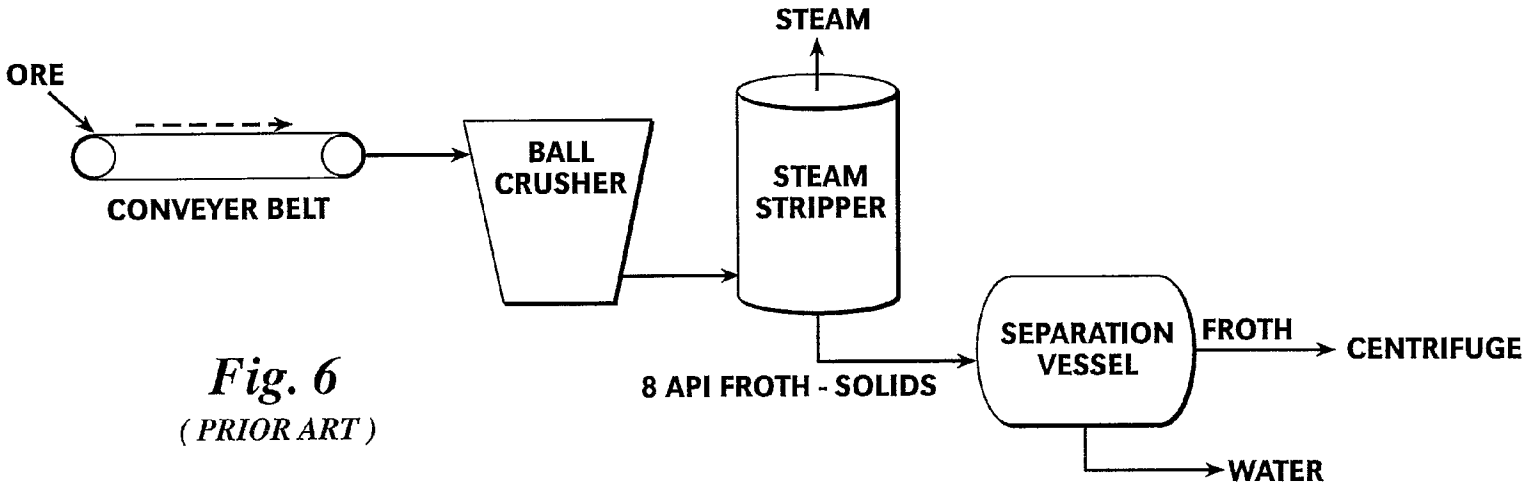
Fig. 6 ( PRIOR ART )
FIG. 6 is a flow diagram of the prior art process for separating water and crude oil from an oil sand.

The present invention also includes the use of the high temperature high pressure electrostatic treater for use in refining bitumen recovered from oil sands. The prior art process for treating such bitumen as shown in FIG. 6 involves crushing the oil sands or ore in a ball crusher to obtain a desired particle size. The crushed or pulverized ore is then introduced into a steam stripper where the bitumen is removed from the particulates by application of high pressure steam. Excess steam is removed from the stripper. A bitumen froth having some solids and a gravity of approximately 8 API is also produced. This froth is injected into a separation vessel where free water is removed. The remaining froth is then processed in a centrifuge to separate the water from the bitumen.

Figure 7:
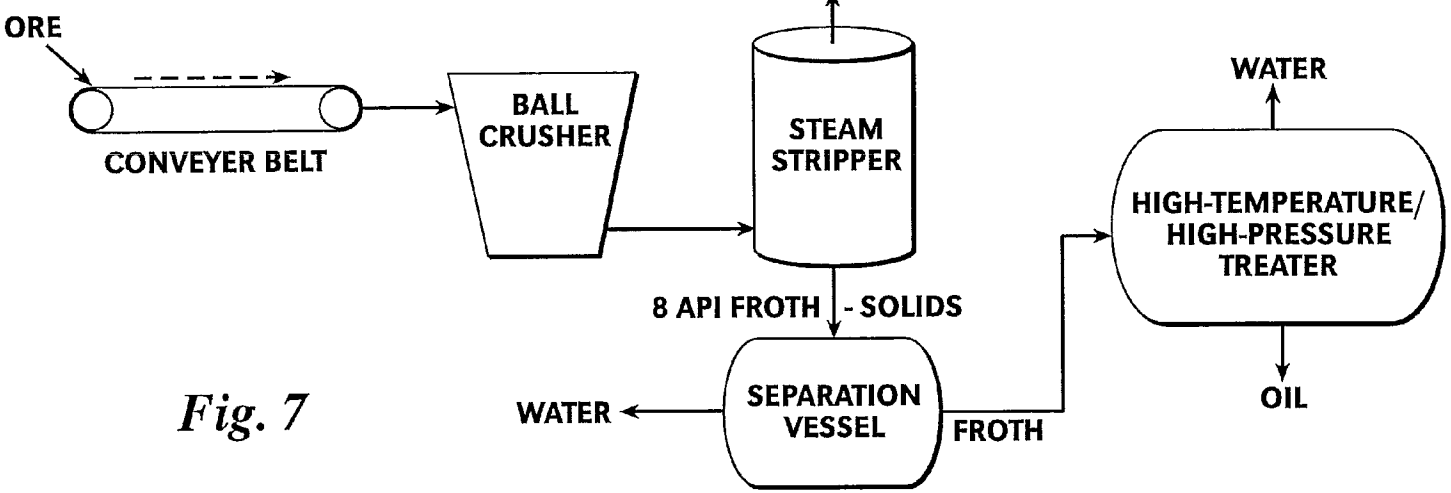
FIG. 7 is a flow diagram of one embodiment of the present invention which is a process for separating crude oil and water from an oil sand.

FIG. 7 illustrates the preferred embodiment of the present invention process when it is used to separate water from bitumen refined from oil sands ore or other ores. First, the ore is crushed or pulverized in a ball crusher. The crushed or pulverized ore is then stripped of the bitumen through use of a steam stripper. The excess steam is removed from the steam stripper in one stream. Another stream removes the bitumen containing material. At this stage the material is a froth which contains solids and has a gravity of approximately 8 API. The froth is then run through a separation vessel to remove any free water. After the free water has been removed, the remaining froth is introduced into the high temperature high pressure electrostatic treater 20. The operation of the high temperature high pressure electrostatic treater 20 is the same as that explained above for processing of heavy crudes.

The foregoing description details certain preferred embodiments of the present invention and describes the best mode contemplated. It will be appreciated, however, that changes may be made in the details of construction and the configuration of components without departing from the spirit and scope of the disclosure. Therefore, the description provided herein is to be considered exemplary, rather than limiting, and the true scope of the invention is that defined by the following claims and the full range of equivalency to which each element thereof is entitled.

What is claimed is:

1. A method for separating water from bitumen, the method comprising the steps of:

removing free water from the bitumen to produce a bitumen stream containing about 10% to 25% wgt. water;

adding diluent to the bitumen stream in an amount no greater than 10% wgt. to create a dilbit stream; and passing the dilbit stream through an interior volume of a high temperature high pressure electrostatic treater at a temperature in a range of about 380° F. to 460° F. and a pressure in a range of about 195 psia to 467 psia, the interior volume containing a water zone, a wet bitumen zone located below the water zone, a dry bitumen zone located below the wet bitumen zone, and a boundary layer located between the water and wet bitumen zones, the treater including:

a wet bitumen inlet located in an upper portion of the treater and connected to a first header located within the wet bitumen zone and spanning a length of the interior volume and arranged to create a downward vertical flow within the wet bitumen zone and toward a dry bitumen outlet located in a lower portion of the treater and connected to a second header located within the dry bitumen zone and spanning a length of the interior volume; and a plurality of spaced-apart vertically positioned plate electrodes located below the first header and in the wet bitumen zone;

wherein the water and bitumen are separated by electrical charges.

2. The method of claim 1, wherein the interior volume has a pressure ranging from about 280 psia to 340 psia.

3. A method for removing bitumen and water from oil sands ore, the method comprising the steps of:

removing free water from the bitumen to produce a bitumen stream containing about 10% to 25% wgt. water;

adding diluent to the bitumen stream in an amount no greater than 10% wgt. to create a dilbit stream;

flowing the bitumen as it exits a wet bitumen header of a treater vessel past a plurality of adjacent spaced-apart vertically positioned charged plate electrodes, the wet bitumen header and plate electrodes being within a wet bitumen zone of the treater vessel with the plate electrodes being located below the wet bitumen header, the treater vessel being at a temperature in a range of about 380° F. to 460° F. and a pressure in a range of about 280 psia to 340 psia; and removing water and dry bitumen from the treater vessel, the water being removed at a higher elevation than the dry bitumen.

* * * * *